US006601783B2

(12) United States Patent
Chisum et al.

(10) Patent No.: US 6,601,783 B2
(45) Date of Patent: Aug. 5, 2003

(54) ABRASIVEJET NOZZLE AND INSERT THEREFOR

(76) Inventors: Dennis Chisum, 1299 "A" St. S.E., Ephrata, WA (US) 98823; Perry Freeborn, 6503 Longlake Dr., Nine Mile Falls, WA (US) 99026

( * ) Notice: Subject to any disclaimer, the term of this patent is extended or adjusted under 35 U.S.C. 154(b) by 0 days.

(21) Appl. No.: 09/844,113

(22) Filed: Apr. 25, 2001

(65) Prior Publication Data

US 2002/0190144 A1 Dec. 19, 2002

(Under 37 CFR 1.47)

(51) Int. Cl.[7] ..... B05B 7/04

(52) U.S. Cl. ..... 239/433; 239/589; 239/600; 451/75; 451/102

(58) Field of Search ..... 239/433, 434, 239/589, 590, 591, 600; 451/75, 102

(56) References Cited

U.S. PATENT DOCUMENTS

| | | | | |
|---|---|---|---|---|
| 2,176,577 A | | 10/1939 | Tirrell | |
| 3,419,220 A | | 12/1968 | Goodwin et al. | |
| 3,982,605 A | | 9/1976 | Sneckenberger | |
| 3,994,097 A | | 11/1976 | Lamb | |
| 4,149,345 A | | 4/1979 | Atsuchi | |
| 4,218,855 A | | 8/1980 | Wemmer | |
| 4,380,138 A | | 4/1983 | Hofer | |
| 4,478,368 A | | 10/1984 | Yie | |
| 4,545,157 A | | 10/1985 | Saurwein | |
| 4,587,772 A | | 5/1986 | Griffiths | |
| 4,631,871 A | | 12/1986 | Saunders | |
| 4,663,893 A | | 5/1987 | Savanick et al. | |
| 4,666,083 A | * | 5/1987 | Yie | 239/433 |
| 4,702,042 A | | 10/1987 | Herrington et al. | |
| 4,707,952 A | | 11/1987 | Krasnoff | |
| 4,711,056 A | | 12/1987 | Herrington et al. | |
| 4,815,241 A | | 3/1989 | Woodson | |
| 4,817,874 A | | 4/1989 | Jarzebowicz | |
| 4,852,800 A | | 8/1989 | Murdock | |

(List continued on next page.)

FOREIGN PATENT DOCUMENTS

| | | |
|---|---|---|
| CA | 484524 | 7/1952 |
| DE | 494888 | 3/1930 |
| DE | 1477991 | 7/1969 |
| DE | 4005691 A1 | 8/1991 |
| DE | 40 05 691 A1 | 8/1991 |
| WO | 0983 823 A1 | 3/2000 |
| WO | WO02/085572 A1 | 10/2002 |

*Primary Examiner*—Steven J. Ganey
(74) *Attorney, Agent, or Firm*—Birch, Stewart, Kolasch & Birch, LLP

(57) ABSTRACT

An abrasivejet cutting head is disclosed for use in an abrasivejet cutting system. The cutting head includes a replaceable generally cylindrical insert member having a fluid passageway aligned with the passageway of the housing. A waterjet-forming orifice member is supported within the insert in axial alignment with the abrasivejet discharge nozzle located at the downstream end of the cutting head. The insert is locked into the cutting head by the sleeve of an abrasive-carrying conduit, and provides the mixing region in which the abrasive is entrained into the waterjet. By making the jet-forming orifice and mixing region an integral unit, the mixing chamber is conveniently changed every time the wear in the jet-forming orifice requires an orifice change to maintain high cutting efficiency, while adding virtually no cost in additional components since it merely requires a slightly elongated insert than would otherwise be necessary. In addition, the relatively expensive abrasivejet nozzle, which is typically the longest lasting component of the three, need not be replaced until necessary and, when necessary, is easily removed and replaced in co-axial alignment with the orifice. Lastly, the arrangement results in self-alignment of the waterjet-forming orifice, the mixing region and the abrasivejet nozzle.

15 Claims, 2 Drawing Sheets

U.S. PATENT DOCUMENTS 4,862,911 A 9/1989 Yie
4,934,111 A 6/1990 Hashish et al.
4,936,059 A 6/1990 Hashish et al.
5,018,670 A * 5/1991 Chalmers ..... 239/433
5,144,766 A * 9/1992 Hashish et al. ..... 451/102
5,273,405 A 12/1993 Chalmers et al.
5,320,289 A * 6/1994 Hashish et al. ..... 239/600
5,794,858 A * 8/1998 Munoz ..... 451/102
5,851,139 A * 12/1998 Xu ..... 239/433
5,908,349 A * 6/1999 Warehime ..... 239/433
5,980,349 A 11/1999 Hofmann et al.

* cited by examiner

ABRASIVEJET NOZZLE AND INSERT THEREFOR

FIELD OF THE INVENTION

The use of high velocity, abrasive-laden liquid jets to precisely cut a variety of materials is well known. Briefly, a high velocity liquid jet is first formed by compressing the liquid to an operating pressure of 3,500 to 150,000 psi, and forcing the compressed liquid through an orifice having a diameter approximating that of a human hair; namely, 0.003–0.040 inches. The resulting highly coherent jet is discharged from the orifice at a velocity which approaches or exceeds the speed of sound. The liquid most frequently used to from the jet is water, and the high velocity jet described hereinafter may accordingly be identified as a waterjet. Those skilled in the art will recognize, however, that numerous other liquids can be used without departing from the scope of the invention, and the recitation of the jet as comprising water should not be interpreted as a limitation.

To enhance the cutting power of the liquid jet, abrasive materials have been added to the jet stream to produce an abrasive-laden waterjet, typically called an "abrasive jet". The abrasive jet is used to effectively cut a wide variety of materials from exceptionally hard materials (such as tool steel, aluminum, cast iron armor plate, certain ceramics and bullet-proof glass) to soft materials (such as lead). Typical abrasive materials include garnet, silica, and aluminum oxide having grit sizes of #36 through #200.

To produce the abrasive-laden waterjet, the waterjet passes through a "mixing region" wherein a quantity of abrasive is entrained into the jet by the low pressure region which surrounds the flowing liquid in accordance with the Venturi effect. The abrasive, which is under atmospheric pressure in an external hopper, is drawn into the mixing region by the by the lower pressure region via a conduit that communicates with the interior of the hopper. In operation, quantities of up to 6 lbs./min of abrasive material have been found to produce a suitable abrasive jet.

The resulting abrasive-laden waterjet is then discharged against a workpiece through an abrasivejet nozzle that is supported closely adjacent the workpiece.

The material defining the waterjet-forming orifice is typically a hard jewel such sapphire, ruby or diamond. Typical abrasive materials include garnet, silica, and aluminum oxide having grade sizes of #36 through #120. Those skilled in the art recognize that the abrasive material represents the highest hourly operating cost associated with abrasivejet cutting.

Because the waterjet and abrasivejet are so destructive, wear of the jet-forming components is of particular concern. As the jet-forming orifice, mixing region and abrasivejet nozzle become worn, cutting efficiency decreases dramatically. The result is that the cutting process is dramatically slowed, and an excess of abrasive material is consumed in performing the cutting operation. Thus it is necessary to regularly change the jet-forming orifice, the mixing chamber and the abrasivejet nozzle.

To maximize the life of the mixing region and abrasivejet nozzle, it is highly desirable to align them with the waterjet's axis. Because the fluid path thorough jet housing is several inches long, very minute alignment errors (e.g., a few tenths of a thousandths inch) are enough to cause premature failure of the abrasive jet nozzle.

One disclosed technique for resolving the alignment problem associated with abrasivejet assemblies is disclosed in U.S. Pat. No. 4,817,874 wherein an abrasive jet nozzle is pivotably movable into alignment with the waterjet-forming orifice.

A second technique is disclosed in U.S. Pat. No. 5,144,766 wherein an integral cartridge with the jet-forming orifice, mixing region and abrasivejet nozzle is disclosed.

SUMMARY OF THE INVENTION

Briefly, the invention herein is an abrasivejet cutting head assembly for use in an abrasivejet cutting system of the type wherein the cutting head is coupled to a source of abrasive via an abrasive-carrying conduit, and to a source of high pressure water. The abrasivejet cutting head herein is an assembly that comprises a housing having a body disposed about a longitudinal axis between upstream and downstream ends, a first longitudinally-extending passageway in communication with said ends, and a conduit-accommodating passageway extending generally radially from the exterior of the body into a region in the longitudinal passageway. The body is adapted to be coupled to a source of high pressure liquid at its upstream end, and to be coupled to an abrasivejet nozzle at its downstream end.

The assembly includes a removable novel insert member within the first longitudinally-extending passageway, which has upstream and downstream faces, a second longitudinally-extending fluid passageway in communication with said faces and in axial alignment with the first longitudinal passageway, and a radially-extending passage that is aligned with the conduit-accommodating passageway of the housing to place an accommodated conduit in fluid communication with the second longitudinally extending passageway adjacent a mixing region within the insert. The insert member is securable against movement within the housing by the insertion of the sleeve of the abrasive-carrying conduit into its radially-extending passageway An orifice member is supported within the insert member upstream from the mixing region, and has a waterjet-forming orifice in axial alignment with the second longitudinally-extending passageway. Means are included for securing an abrasivejet nozzle into the downstream end of the housing so that the nozzle is in substantial axial alignment with the second longitudinal passageway.

Additional details concerning the invention will be apparent to those of ordinary skill in the art from the following description of the preferred embodiment, of which the Drawing forms a part.

DESCRIPTION OF THE PREFERRED EMBODIMENT

Figure 1:
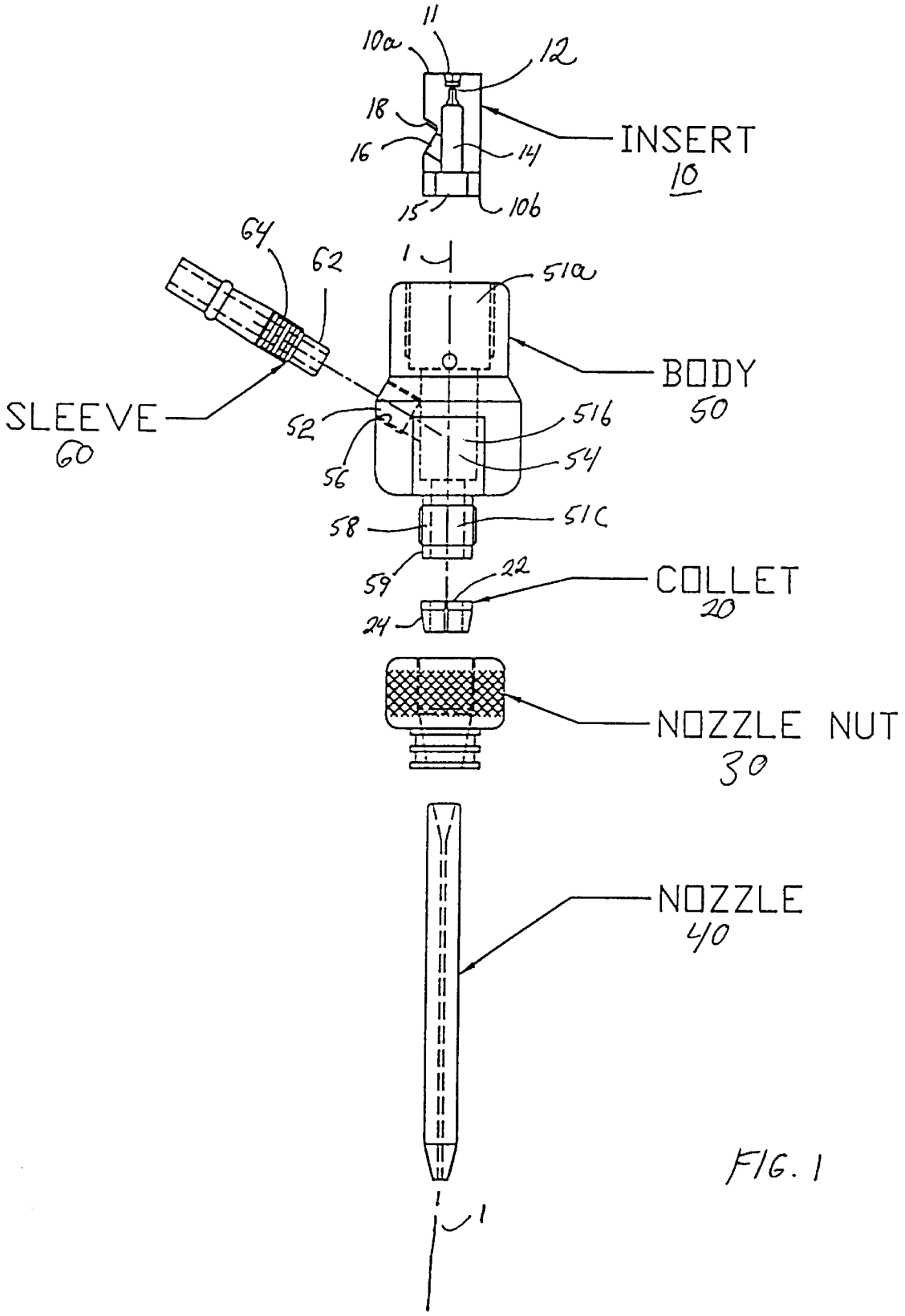
FIG. 1 is an exploded sectional front elevation view, in schematic, of a self-aligning abrasive jet assembly constructed in accordance with the invention.

FIG. 1 is an exploded sectional front elevation view, in schematic, of a self-aligning abrasive jet assembly constructed in accordance with the invention. As will be described in additional detail below, an insert 10 encloses and supports a water-jet-forming orifice member 12, as well as a mixing region 14, within a housing 50. The insert 10 is prevented from moving within the housing 50 by a sleeve 60 of an abrasive-carrying conduit, which securely engages the insert via an opening 52 in the housing. An abrasivejet nozzle 40 is inserted into the downstream end of the housing 50 until the upstream end of the nozzle 40 is adjacent the downstream end of the insert 10. A nozzle nut 30 is tightened onto the body 50 to secure the abrasivejet nozzle 40 in alignment with the waterjet-forming orifice via a collet 20. The resulting assembly locks the mixing region and abrasivejet nozzle into secure alignment with the jet-forming orifice, thereby minimizing wear and maintaining a high degree of cutting efficiency for an extended period of time.

The insert 10 is generally cylindrical in shape, and is preferably formed from a material such as stainless steel, titanium, carbide or high strength ceramic. A longitudinally-extending fluid passageway extends and communicates between the upstream end 10*a* and the downstream end 10*b* of the insert. In use, the insert is coupled at its upstream end to a source of high pressure fluid, such as water.

A waterjet-forming orifice member 12 is mounted within the upstream region of the insert. In use, the orifice creates a high pressure waterjet which travels longitudinally towards downstream end 10*b* of the insert. An abrasive-conducting passageway 16 extends generally radially from the exterior of the insert 10 into the longitudinally-extending passageway 14.

The body 50 is disposed about a longitudinal axis 1, and is conveniently formed from 15-5 stainless steel, or any other suitable material. The body has a generally annular cross-section through-out its length, with its through-passage having an upstream region 51*a* of comparatively large internal diameter sized to accommodate the insert, a midsection 51*b* of relatively smaller internal diameter, and a downstream region 51*c* having the smallest internal diameter of the three regions. A conduit-accommodating passageway 52 extends generally radially from the exterior of the body to the midsection 51*b* of the through-passage, preferably at an angle of 30 degrees (i.e., 60 degrees with respect the longitudinal axis 1. The passageway 52 is internally threaded at 56. Those skilled in the art will recognize that the 30 degree angle described above permits a smooth flow and efficient entrainment of abrasive. This invention is not so limited, however, since any orientation from 0–70 degrees can be used with suitable dimensional changes in the assembly if appropriate.

The body 50 terminates at its downstream end in a neck 59 circumventing the downstream region 51*c* of the through-passage. The neck is externally threaded at 58 to mate with the internal threads of the nozzle nut 30. As will be appreciated, the body 50, itself, is not subjected to high pressure fluid, and its material may be selected accordingly.

During assembly, the downstream end 10*b* of the insert 10 is inserted longitudinally into the upstream end of the body 50 until it is stopped at the interface between the upstream 51*a* and mid-section 51*b* portions of the through-passage. The insert is oriented within the body 50 so that its abrasive-accommodating passage 16 is generally aligned coaxially with the axis of the body's conduit-accommodating passageway 52.

A sleeve 60, co-axially mounted about the abrasive-carrying conduit, locks the insert 10 into position. The sleeve 60 has external threads 64 which mate with the internal threads 56 of the passageway 16 as the sleeve is screwed into the passageway. The sleeve 60 is accordingly rotatable about its common axis with the abrasive-carrying conduit, and urges the discharge end 62 of the conduit into the passage way 16 of the insert.

A flat surface 18 is machined into the insert 10 around the mouth of the abrasive passage 16 for contact by the leading surface of the sleeve 50 as it is tightened into the body 50. If the abrasive passageway 16 of the insert has become rotatably offset from co-axial alignment with the body's conduit-accommodating passage 52, the insert 10 will rotate into such alignment as a result of the force exerted by the advancing forward surface of the sleeve against the flat surface 18. A longitudinal elevation view in sectional of the assembled abrasivejet assembly is shown in FIG. 2.

Figure 2:
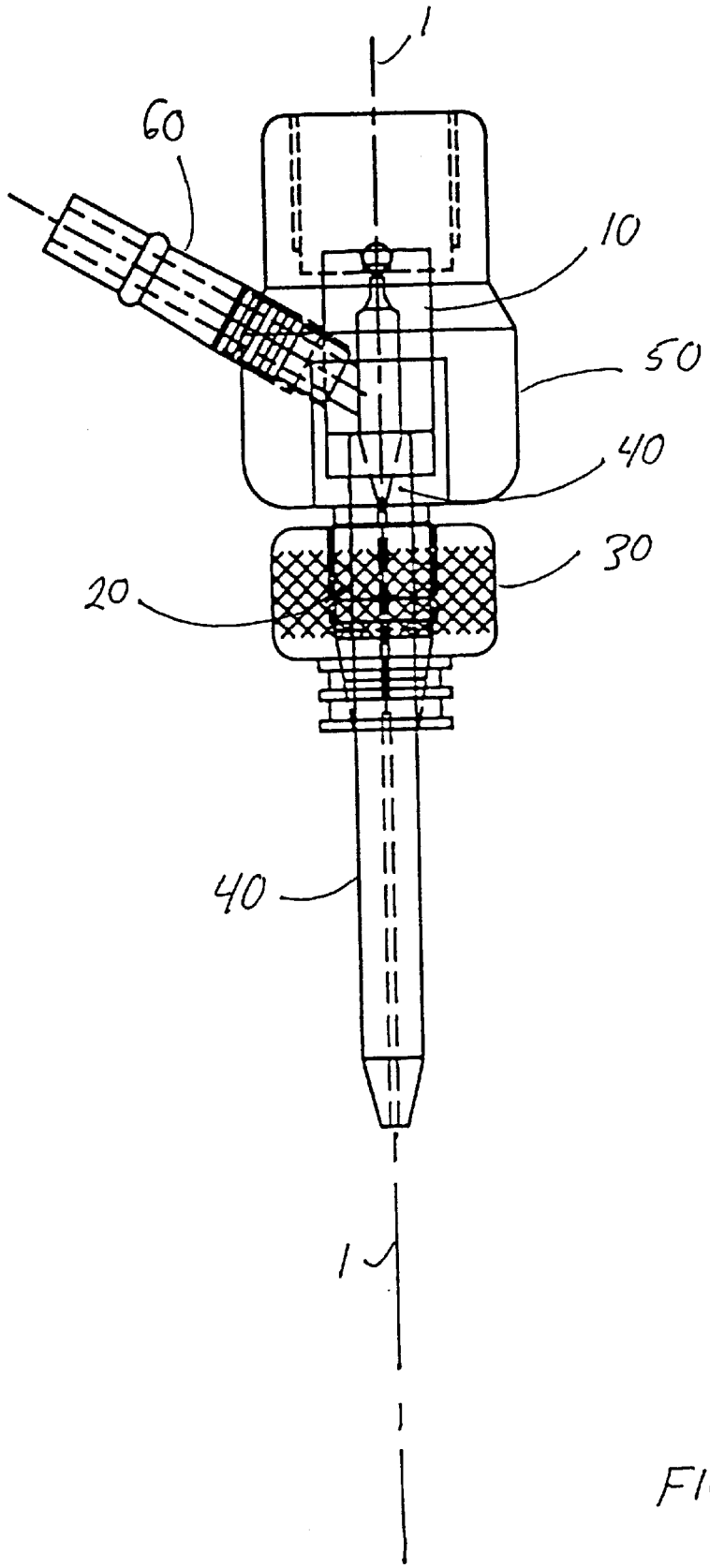
FIG. 2 is a sectional front elevation view, in schematic, of the assembled abrasive jet assembly shown in FIG. 1.

As may be more clearly seen in FIG. 2, insert 10 becomes locked within body 50 when the sleeve 60 is screwed into passageway 52. The sleeve 60 extends through the passageway 16 of the insert, thereby preventing the insert from rotating or moving vertically.

As shown more clearly in FIG. 2, the mixing region 54 is located within the downstream region of the insert 1, where abrasive is entrained into the waterjet, and its co-axial alignment with the waterjet-forming orifice is assured by their mutual integration into a single self-aligned unit.

The abrasivejet nozzle is then mounted onto the housing 50 in axial alignment with the waterjet-forming orifice by tightening the nozzle nut 30 onto the neck 59 of the body. The nozzle is first inserted into the body's downstream passage 51(*c*), and the nut (with captured collet 20 therein) is tightened onto the neck. Those skilled in the art recognize that a collet is a cone-shaped sleeve used for holding circular or rod-like pieces. As the leading face 22 of the collet butts up against the opposing face of the neck 59, it is driven back into the nut 40. The interior diameter of the nut increasingly squeezes the outwardly tapered sides 24 of the collet radially inward as the nut is tightened further, compressing the collet radially inward about the nozzle 40, and securely gripping the nozzle within the body so that it is coaxially aligned with the jet-forming orifice 12.

The downstream portion of the insert 10 provides a mixing region having a smaller or equal diameter vis-a-vis the internal diameter of the abrasivejet nozzle 40. Accordingly, the top edge of the nozzle is not exposed to abrasive, and there is no interruption in the entrainment of abrasive arising from discontinuities as the jet enters the abrasivejet nozzle.

In operation, the jet-forming orifice wears relatively rapidly, followed by the mixing region and then the abrasivejet nozzle. By making the jet-forming orifice and mixing region an integral unit, the mixing chamber is conveniently changed every time the wear in the jet-forming orifice requires an orifice change. Yet additionally changing the mixing region adds virtually no cost in additional components, since it merely requires a slightly elongated insert than would otherwise be necessary. At the same time, the second-quickest wearing component has been easily replaced so it will not be a further source of cutting inefficiency.

In addition, the relatively expensive abrasivejet nozzle, which is typically the longest lasting component of the three, need not be replaced until necessary and, when necessary, is easily removed and replaced in co-axial alignment with the orifice.

Lastly, the protrusion of the abrasive-carrying conduit into the insert eliminates any voids between the abrasive-carrying conduit and the mixing region which could form a pocket for wear that would interrupt the smooth flow of abrasive and result once again in a decrease in cutting efficiency.

In practice, we have determined that the following dimensions (in inches) result in a suitable abrasivejet assembly:

| | |
|---|---|
| Insert 10: | 0.980 (1) × 0.490 (dia.)<br>passage 11: 0.94 (1) × 0.150 (dia.)<br>orifice diameter = 0.046 inches<br>passageway 14: 0.681 (1) × 0.200 inches (dia.)<br>passageway 15: 0.187 (1) × 0.282 inches (dia.)<br>Passageway 16: 0.180 dia. |
| Body 50: | passageway 51a: 0.688 (1) × 0.688 (dia.)<br>passageway 51b: 0.887 (1) × 0.491 (dia.)<br>passageway 51c: 0.625 (1) × 0.290 (dia.) |
| Sleeve 60 | length: 1.5<br>discharge end 62: 0.250 (1) × 0.250 (dia.)<br>threaded portion 64: 0.312 (1) with<br>5/16 × 24 UNF threads |
| collet 20: | OD tapers from 0.562 to 0.43<br>length: 0.25<br>ID: 0.28<br>gap: 0.03 |
| Abrasivejet nozzle: | 0.281 O.D.<br>Inlet cone: at widest point: 0.2 dia. |

Those skilled in the art will recognize that many variations may be made in the disclosed embodiment without departing from the spirit of the invention. For example, the insert 10 may be formed from more than a single material. When a diamond waterjet-forming orifice member is to be used, it is preferable that the mixing region portion of the insert outlast the diamond orifice. The downstream portion of the insert encompassing the mixing region is preferably made of carbide under those circumstances, but the orifice member cannot currently be firmly seated against carbide. Accordingly, the top portion of the insert can be formed from stainless steel or other suitable material, and secured to the carbide portion by press-fitting or other means.

Likewise, the insert 10 can be secured by the abrasive-carrying conduit using mating male and female chamfers, or slots and pins or set screws.

Thus, while the foregoing description includes detail which will enable those skilled in the art to practice the invention, it should be recognized that the description is illustrative in nature and that many modifications and variations will be apparent to those skilled in the art having the benefit of these teachings. It is accordingly intended that the invention herein be defined solely by the claims appended hereto, and that the claims be interpreted as broadly as permitted in light of the prior art.

We claim:

1. For use in an abrasivejet cutting system of the type including an abrasive-carrying conduit terminating in a sleeve and a source of high pressure water, an abrasivejet assembly comprising:

(A) a housing having a body disposed about a longitudinal axis between upstream and downstream ends, a first longitudinally-extending passageway in communication with said ends, and a conduit-accommodating passageway extending generally radially from the exterior of the body into a region in the longitudinal passageway, said body being adapted to be coupled to a source of high pressure liquid at its upstream end, and to be coupled to an abrasivejet nozzle at its downstream end;

(B) a removable insert member within the first longitudinally-extending passageway and having (1) upstream and downstream faces, (2) a second longitudinally-extending fluid passageway in communication with, said faces and in axial alignment with the first longitudinal passageway, and (3) a radially-extending passage aligned with the conduit-accommodating passageway of the housing to place an accommodated conduit in fluid communication with the second longitudinally extending passageway adjacent a mixing region within the insert, the insert member being securable against movement within the housing by the insertion of the sleeve of the abrasive-carrying conduit into its radially-extending passageway;

(C) an orifice member having a waterjet-forming orifice and supported within the insert member upstream from the mixing region with its orifice in axial alignment with the second longitudinally-extending passageway;

the insert member having a surface characteristic at the region of its downstream face for receiving the upstream end of a separable abrasivejet nozzle in substantial axial alignment with the second longitudinally-extending passageway; and (D) means for securing the abrasivejet nozzle at the downstream end of the housing so that the nozzle is maintained in substantial axial alignment with the second longitudinally-extending passageway.

2. For use in the cutting head of an abrasivejet cutting system of the type utilizing a replaceable and generally axially-extending abrasivejet nozzle having upstream and downstream ends, an insert member comprising:

a body having an upstream end region, a downstream end region, and a longitudinally-extending fluid passageway communicating therebetween;

a waterjet-forming orifice-defining structure positioned within the upstream end region of the body, the orifice being formed about an axis and being positioned so that the orifice is aligned with said passageway to direct a waterjet towards the downstream end region when the upstream end of the body receives water from a source of high pressure water coupled to its upstream end region;

the body further including a passageway extending generally radially inward from the exterior of the body for conducting an abrasive into the passageway at a region downstream from said orifice so that the abrasive is entrained into the waterjet within the longitudinally-extending passageway, the body further including a surface feature at its downstream end region for receiving the upstream end of the abrasivejet nozzle in substantial axial alignment with the axis of the orifice.

3. The insert member of claim 2 wherein the body of the insert further includes a surface portion in the region where the radially inwardly-extending passageway meets the exterior of the body, the surface portion being positioned for contact by the leading end portion of an abrasive-conducting conduit and shaped to secure the insert within the cutting head and with substantial axial alignment between the orifice and the abrasivejet nozzle.

4. The insert member of claim 3 wherein the surface portion is a flat region.

5. The insert member of claim 2 wherein the longitudinally-extending passageway at the downstream end region of the insert member is sized slightly larger than the exterior dimension of the abrasivejet nozzle's upstream end region to permit entry of the nozzle's end region within the insert member.

6. The insert member of claim 5 wherein the longitudinally-extending passageway at the downstream end region of the insert member is sized approximately 0.001 inches greater than the exterior dimension of the abrasivejet nozzle's upstream end region to permit entry of the nozzle's end region within the insert member while imposing substantial axial alignment of the nozzle and orifice.

7. The insert member of claim 5 wherein the longitudinally-extending passageway downstream from the radially-extending passageway and upstream of the permitted entry of the abrasivejet nozzle is sized smaller than the interior dimension of the abrasivejet nozzle's upstream end region.

8. An abrasivejet cutting head comprising:

a housing disposed about a longitudinal axis between upstream and downstream ends in fluid communication via a longitudinally-extending through-passage, said through-passage having an upstream region of comparatively large internal diameter sized to accommodate an insert member, a midsection of relatively smaller internal diameter, and a downstream region having an internal diameter smaller than the upstream region;

said housing further including a conduit-accommodating passageway extending generally radially from the exterior of the housing to the midsection of the through-passage, the body terminating at its downstream end in a threaded neck circumventing the downstream region of the through-passage, a threaded member rotatably advancable along said threaded neck;

said insert member having a longitudinally-extending through passageway, a waterjet-forming orifice-defining structure within the passageway, and a generally radially-extending abrasive-accommodating conduit leading from the outside of the insert to a region within the passageway downstream from the orifice to permit entering abrasive to be entrained into the formed waterjet within said downstream region, said insert member being supported within the upstream end of the body and oriented within the body so that its abrasive-accommodating passage is generally aligned coaxially with the axis of the body's conduit-accommodating passageway, the body's conduit-accommodating passage being sized to accept a sleeve co-axially mounted about an abrasive-carrying conduit of the abrasivejet cutting system so that the sleeve can exert a position-stabilizing force against the insert;

means for removably securing the sleeve to the body so that the sleeve locks the insert member into position;

an abrasivejet nozzle mounted into the downstream region of the housing's passageway in general axial alignment with the waterjet-forming orifice; and collet means responsive to the upstream advancement of said threaded member with respect to the neck to secure the nozzle within the body in coaxially alignment with the jet-forming orifice.

9. The abrasivejet cutting head of claim 8 wherein the insert member includes a sleeve-contacting external surface adjacent the abrasive-accommodating passage shaped for response to contact by the leading surface of the sleeve as the sleeve is secured to the body to rotate the insert in a manner that brings its abrasive passageway into co-axial alignment with the body's conduit-accommodating passage as a result of the force exerted by the advancing forward surface of the sleeve on the external surface.

10. For use in an abrasivejet cutting system of the type including an abrasive-carrying conduit terminating in a sleeve and a source of high pressure water, an abrasivejet assembly comprising:

(A) a housing having a body disposed about a longitudinal axis between upstream and downstream ends, a first longitudinally-extending passageway in communication with said ends, and a conduit-accommodating passageway extending generally radially from the exterior of the body into a region in the longitudinal passageway, said body being adapted to be coupled to a source of high pressure liquid at its upstream end, and to be coupled to an abrasivejet nozzle at its downstream end;

(B) a removable insert member within the first longitudinally-extending passageway and having (1) upstream and downstream faces, (2) a second longitudinally-extending fluid passageway in communication with, said faces and in axial alignment with the first longitudinal passageway, and (3) a radially-extending passage aligned with the conduit-accommodating passageway of the housing to place an accommodated conduit in fluid communication with the second longitudinally extending passageway adjacent a mixing region within the insert, (C) an orifice member having a waterjet-forming orifice and supported within the insert member upstream from the mixing region with its orifice in axial alignment with the second longitudinally-extending passageway;

the insert member having a surface characteristic at the region of its downstream face for receiving the upstream end of a separable abrasivejet nozzle in substantial axial alignment with the second longitudinally-extending passageway; and (D) means for securing the abrasivejet nozzle at the downstream end of the housing so that the nozzle is maintained in substantial axial alignment with the second longitudinally-extending passageway.

11. The insert member of claim 10 wherein the body of the insert further includes a surface portion in the region where the radially inwardly-extending passageway meets the exterior of the body, the surface portion being positioned for contact by the leading end portion of an abrasive-conducting conduit and shaped to secure the insert within the cutting head and with substantial axial alignment between the orifice and the abrasivejet nozzle.

12. The insert member of claim 11 wherein the surface portion is a flat region.

13. The insert member of claim 10 wherein the longitudinally-extending passageway at the downstream end region of the insert member is sized slightly larger than the exterior dimension of the abrasivejet nozzle's upstream end region to permit entry of the nozzle's end region within the insert member.

14. The insert member of claim 13 wherein the longitudinally-extending passageway at the downstream end region of the insert member is sized approximately 0.001 inches greater than the exterior dimension of the abrasivejet nozzle's upstream end region to permit entry of the nozzle's end region within the insert member while imposing substantial axial alignment of the nozzle and orifice.

15. The insert member of claim 14 wherein the longitudinally-extending passageway downstream from the radially-extending passageway and upstream of the permitted entry of the abrasivejet nozzle is sized smaller than the interior dimension of the abrasivejet nozzle's upstream end region.

* * * * *